US009093001B1

(12) United States Patent
Heva

(10) Patent No.: US 9,093,001 B1
(45) Date of Patent: Jul. 28, 2015

(54) MECHANICALLY OPERABLE MOTORIZED REMOTE CONTROL FLAG RAISING ASSEMBLY AND MOUNT

(71) Applicant: Richard John Heva, Apache Junction, AZ (US)

(72) Inventor: Richard John Heva, Apache Junction, AZ (US)

( * ) Notice: Subject to any disclaimer, the term of this patent is extended or adjusted under 35 U.S.C. 154(b) by 382 days.

(21) Appl. No.: 13/713,887

(22) Filed: Dec. 13, 2012

(51) Int. Cl.
*G09F 17/00* (2006.01)
*E04H 12/32* (2006.01)

(52) U.S. Cl.
CPC ..... *G09F 17/00* (2013.01); *G09F 17/0091* (2013.01); *G09F 2017/0025* (2013.01)

(58) Field of Classification Search
CPC ..... G09F 17/00; G09F 17/0091; G09F 2017/0025; G09F 2017/0066; E04H 12/32
USPC ..... 116/173, 174, 175; 40/218, 601
See application file for complete search history.

(56) References Cited

U.S. PATENT DOCUMENTS

| | | | | | |
|---|---|---|---|---|---|
| 1,610,663 | A | * | 12/1926 | Diago | 116/173 |
| 2,327,056 | A | * | 8/1943 | Nelson | 116/173 |
| 2,377,219 | A | * | 5/1945 | Ellis | 116/173 |
| 3,418,967 | A | | 12/1968 | Donkersloot | |
| 3,675,615 | A | | 7/1972 | Stangarone et al. | |
| 3,675,616 | A | | 7/1972 | McInnis | |
| 3,737,749 | A | * | 6/1973 | Schmit | 318/472 |
| 3,923,001 | A | * | 12/1975 | Murdock | 116/173 |
| 4,972,794 | A | | 11/1990 | Smyly, Sr. | |
| 5,373,287 | A | * | 12/1994 | Doublet | 340/12.22 |
| 5,983,825 | A | * | 11/1999 | Nowak et al. | 116/173 |
| 6,758,159 | B2 | | 7/2004 | McCudden et al. | |
| 6,883,459 | B2 | | 4/2005 | Maki | |
| 7,426,899 | B1 | | 9/2008 | Heva | |
| 2001/0010201 | A1 | * | 8/2001 | Otterness | 116/173 |
| 2008/0121167 | A1 | | 5/2008 | Randall et al. | |

FOREIGN PATENT DOCUMENTS

| | | | | |
|---|---|---|---|---|
| CN | 202023403 | | 11/2011 | |
| DE | 4114871 | | 12/1991 | |
| EP | 953698 | A1 * | 11/1999 | E04H 12/24 |
| FR | 2720433 | A1 * | 12/1995 | E04H 12/32 |
| KR | 20040009975 | | 1/2004 | |
| KR | 101033695 | | 5/2011 | |

* cited by examiner

*Primary Examiner* — R. A. Smith
(74) *Attorney, Agent, or Firm* — Michael I. Kroll

(57) ABSTRACT

A motorized flag raising and lowering device which comprises a flag pole being hollow and having a storage compartment therein with a side exit port. A pulley is on an upper end of the flag pole and a drive wheel is in a lower end of the flag pole. A continuous halyard extends about the pulley and the drive wheel through the flag pole and out of the side exit port. A flag is connected to the halyard. A reversible motor assembly is mounted to the flag pole and connected to the drive wheel. A mechanism is for operating the reversible motor assembly, whereby when the reversible motor assembly is activated by the operating mechanism the flag can be lowered into the storage compartment within the flag pole, while the flag can also be raised from the storage compartment and out of the exit port for display.

7 Claims, 10 Drawing Sheets

MECHANICALLY OPERABLE MOTORIZED REMOTE CONTROL FLAG RAISING ASSEMBLY AND MOUNT

BACKGROUND OF THE INVENTION

Field of the Invention

The present invention relates generally to flag poles and, more specifically, to a flag pole having a mechanically motorized remote controlled means for the deployment and raising of a flag and the subsequent lowering and self, safe storage of the flag afterward. Comprising the device is motorized pulley on the lower end operable by a remote control, automatic or manual means having cables that run up and through the length of a portion of the interior of the pole, to then exit out of a closable hatch, wherethen a raising flag will finally reach a freewheeling pulley at the top distal end of the flagpole that returns the cable loop, and then terminates the raising progression of the flag. When returning and lowering of the flag occurs, the cycle is reversed and the flag is safely pulled into and housed within the flagpole through said closable hatch. Additionally the flagpole of the device can be equipped with sensors to look for inclement weather to initiate a lowering sequence automatically should a weather event occur.

While there are other automatically raising and lowering flagpoles suitable for the purposes for which they were designed, they would not be as suitable for the purposes of the present invention, as hereinafter described.

SUMMARY OF THE PRESENT INVENTION

A primary object of the present invention is to provide a flagpole having a motorized raising and lowering means operable by a remote control.

Another object of the present invention is to provide a flagpole having a motorized raising and lowering means operable by a remote control that also may be operated by a manual means, or automatic means via a sensor for weather conditions.

Yet another object of the present invention is to provide a flagpole that is hollow with an openable hatch capable of containing a flag for safe storage inside when lowered.

Still yet another object of the present invention is to provide a flagpole having a base portion capable of being rotated in order to reach a more ideal orientation.

Another object of the present invention is to provide a flagpole having linkage for opening and closing a hatch to allow the easy retraction and egress of a flag being raised or lowered through it.

Yet another object of the present invention is to provide a flagpole that is a self contained unit that is mountable and removable from a powered base portion.

Still yet another object of the present invention is to provide a flagpole that is capable of raising a flag from a lowered position to a raised or half mast position via remote, manual or automatic means of actuation.

Additional objects of the present invention will appear as the description proceeds.

The present invention overcomes the shortcomings of the prior art by providing a flagpole having a motorized raising and lowering means operable by a remote control that also may be operated by a manual means, or automatic means utilizing a sensor looking for predefined weather conditions. Additionally by providing a pole having a hollow interior with a linkage operable hatch that allows for protection of the flag when lowered, the easy deployment and retraction therethrough said hatch, and the easy raising of the flag to either the raised or half mast position.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
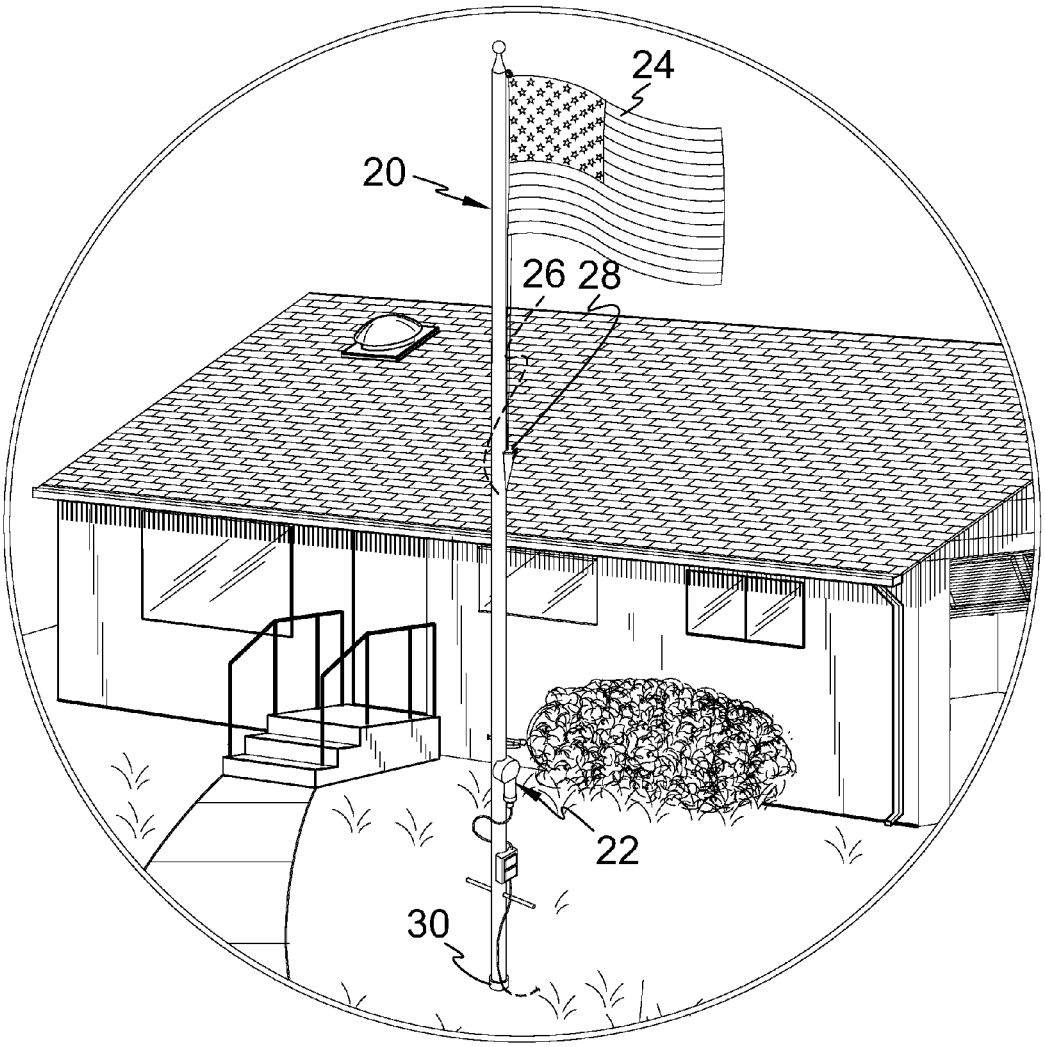
FIG. 1 is an illustrative view of the motorized flag pole of the present invention.

Turning now descriptively to the drawings, in which similar reference characters denote similar elements throughout the several views, the Figures illustrate the motorized flag pole of the present invention. With regard to the reference numerals used, the following numbering is used throughout the various drawing figures.

20 flag pole
22 motor on flag pole 20
24 flag on flag pole 20
26 flag storage compartment in flag pole 20
28 lid on flag pole 20
30 inground receptacle for flag pole 20
32 switch on flag pole 20
34 motor housing of motor 22
36 gear box cover of motor 22
38 trigger on flag pole 20
40 trigger spring for trigger 38
42 line for lid 28

44 gear box of motor 22
46 motor shaft of motor 22
48 drive wheel of motor 22
49 lower elongated aperture in flag pole 20
50 drive wheel housing cover on flag pole 20
52 flag guideway housing on flag pole 20
54 remote control switch for motor 22
56 anemometer on flag pole 20
58 twist handle in flag pole 20
60 weather seal gasket on lid 28
62 lid closure spring for lid 28

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the motorized flag pole of the present invention. Shown is the present invention comprising an inground receptacle mounted flag pole 20 being hollow incorporating a motor 22 for raising a flag 24 from and lowering the flag 24 into a flag pole flag storage compartment 26 in the flag pole 20. A lid 28 prevents water and debris from entering the flag storage compartment 26. An inground receptacle 30 is provided to enable rotation of the flag pole 20 to unwind the flag 24 wrapped around the pole 20.

Figure 2:
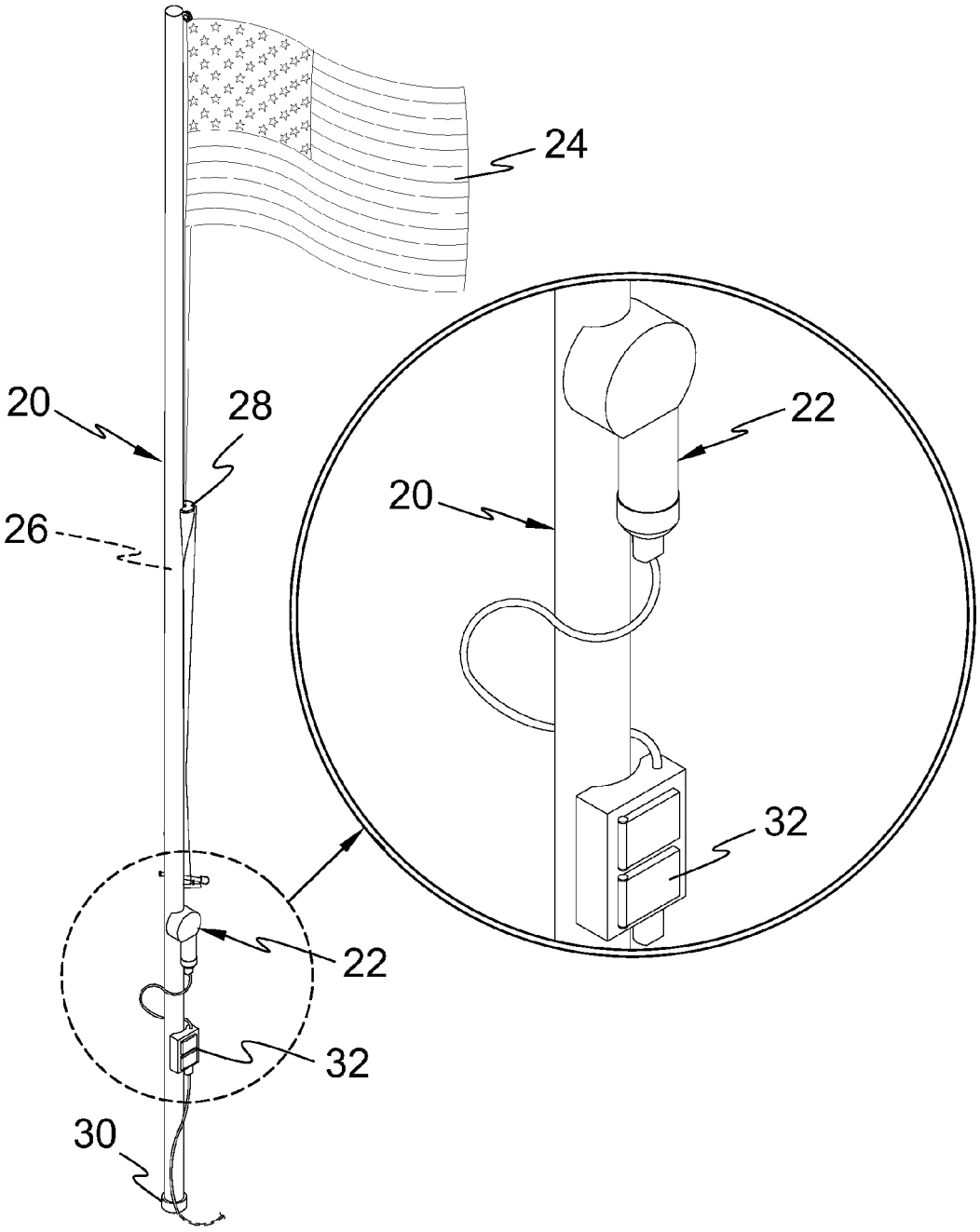
FIG. 2 is an illustrative view of the motorized flag pole of the present invention.

Referring to FIG. 2, shown is an illustrative view of the motorized flag pole of the present invention. Shown is the motorized flag pole 20 having a motor 22 for selectively deploying from a storage compartment 26 and selectively restoring to the storage compartment 26 a flag 24 by a pole mounted switch 32.

Figure 3:
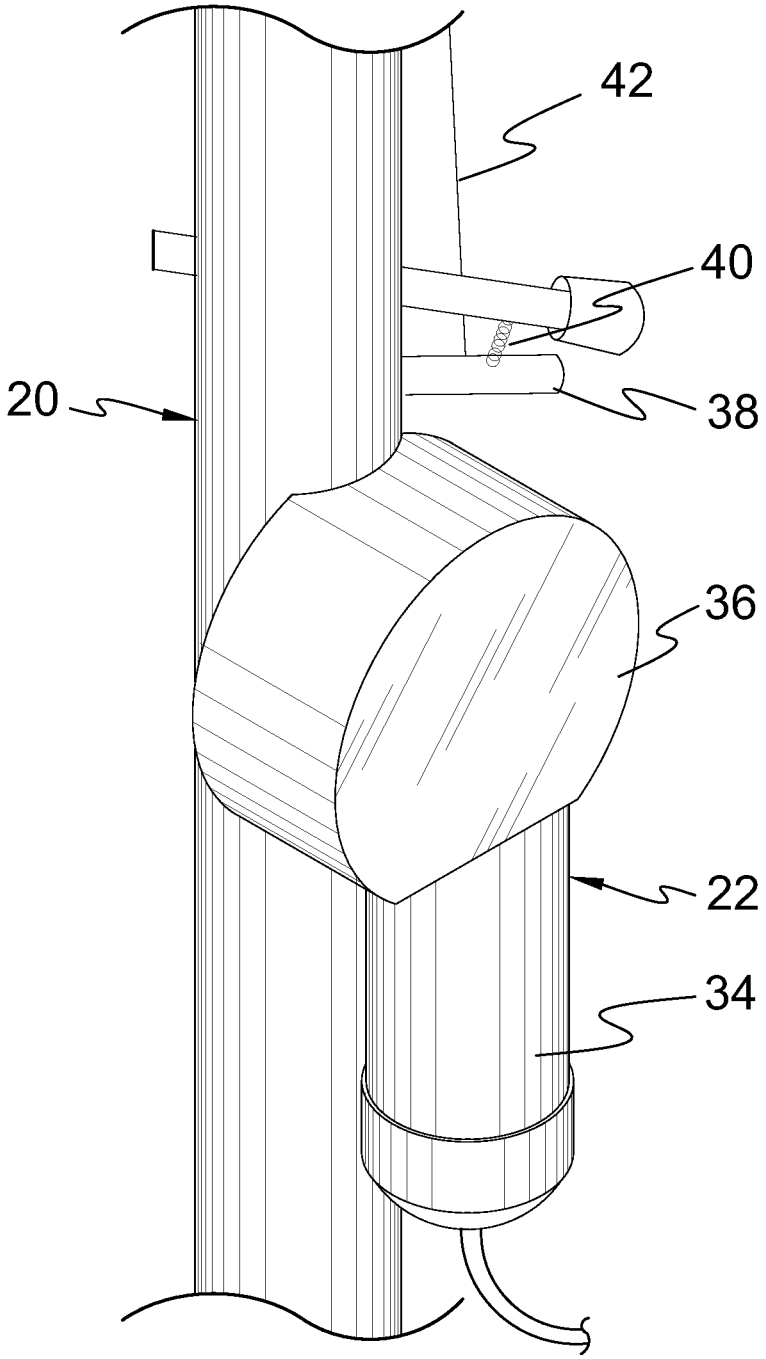
FIG. 3 is a detailed exploded perspective view of the raising and lowering device of the present invention.

Referring to FIG. 3, shown is a detailed exploded perspective view of the raising and lowering device of the present invention. Shown is the present invention having a motor 22 for the raising and lowering of a flag 24 with a respective housing 34 and cover 36 for the components therein. Also shown is a flag compartment trigger 38 having a trigger spring 40. To open the lid 28 the trigger 38 is squeezed, compressing the spring 40 that tensions a line 42 that will raise the lid 28. Release of the trigger 38 extends the trigger spring 30, releasing tension on the line 42, whereupon a lid closure spring will close the compartment lid 28.

Figure 4:
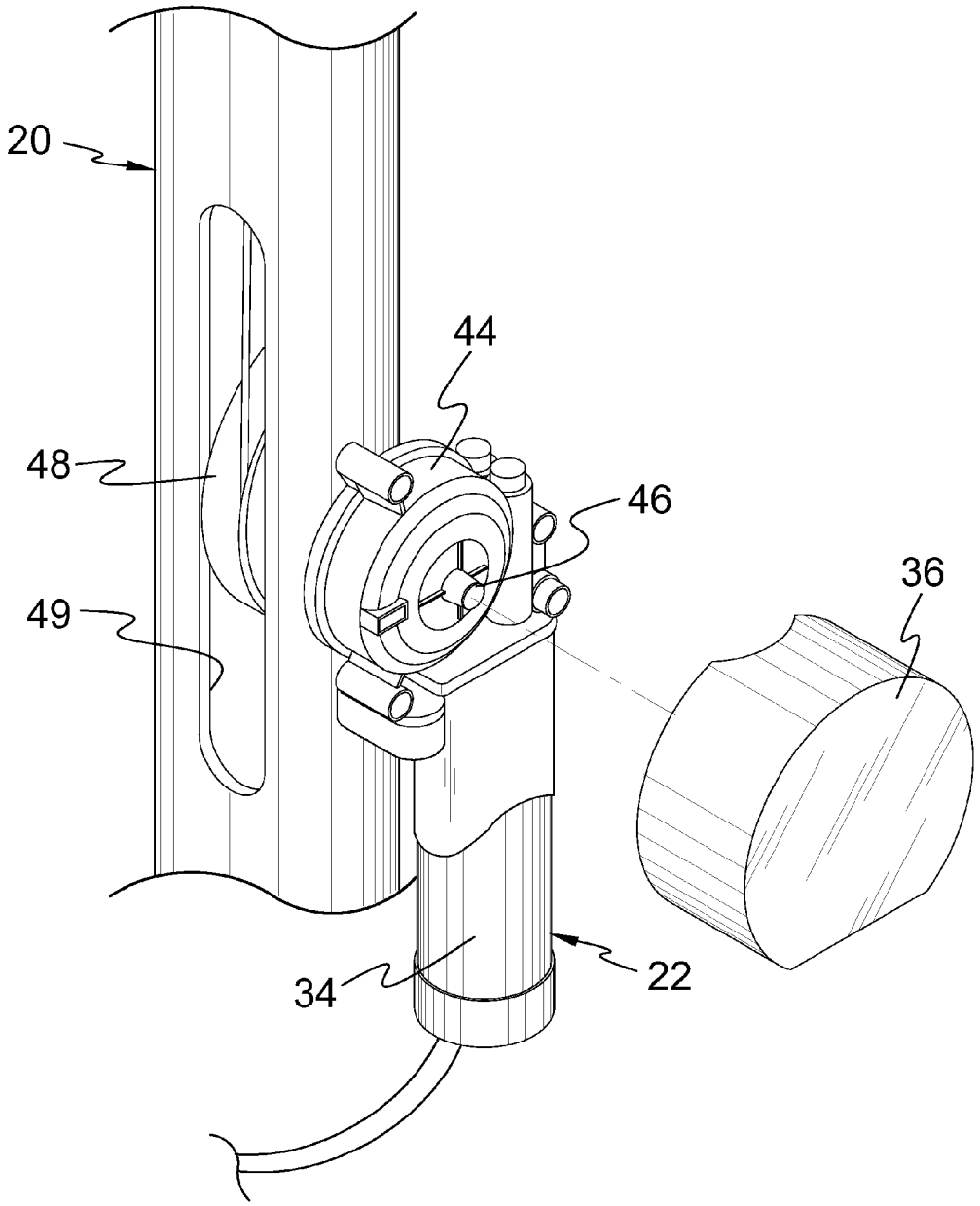
FIG. 4 is a detailed exploded perspective view of the raising and lowering device of the present invention.

Referring to FIG. 4, shown is a detailed exploded perspective view of the raising and lowering device of the present invention. Shown is the present invention having a motorized unit for powering the raising and lowering of a flag 24 comprising a motor 22, gear box 44, motor shaft 46 with mounted drive wheel 48 and a respective cover 36. A lower elongated aperture 49 is in the flag pole 20 adjacent to the drive wheel 48.

Figure 5:
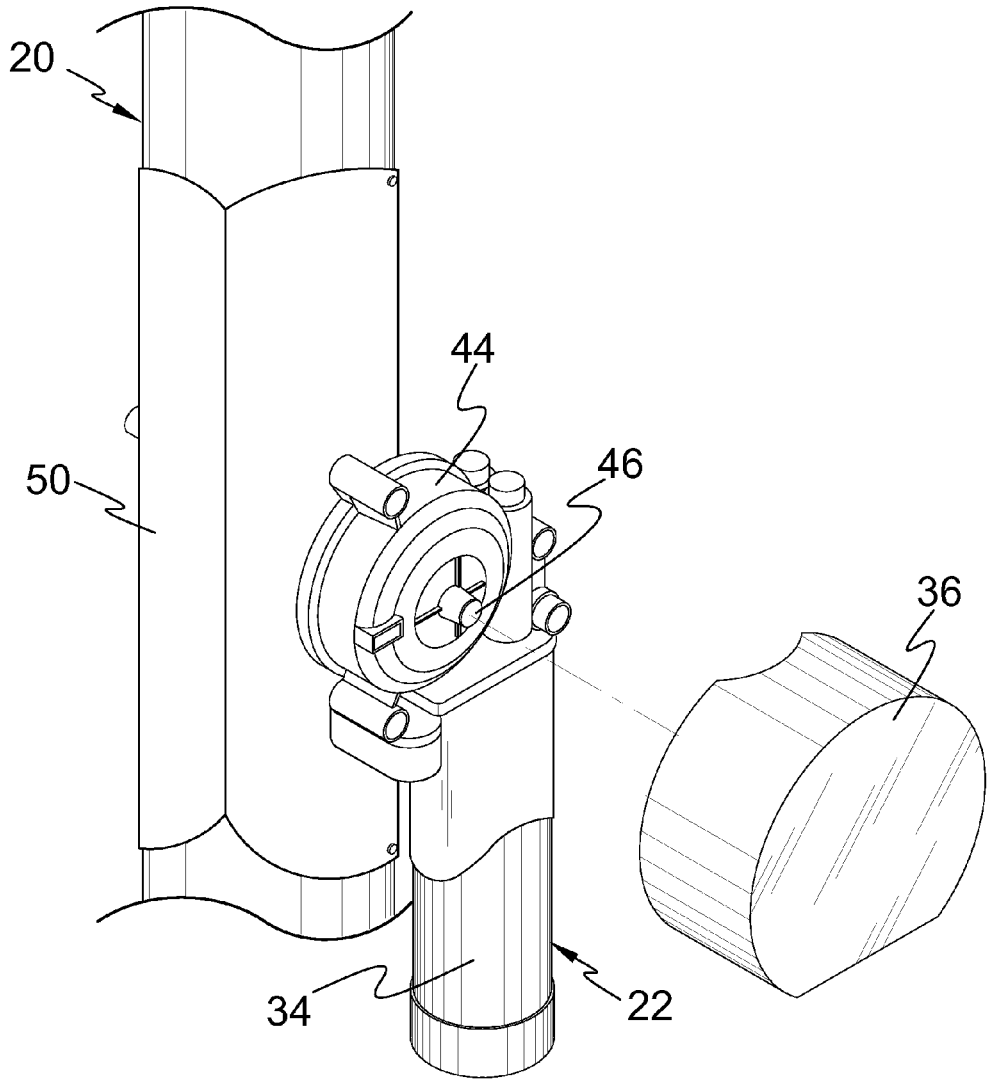
FIG. 5 is a detailed exploded perspective view of the raising and lowering device of the present invention.

Referring to FIG. 5, shown is a detailed exploded perspective view of the raising and lowering device of the present invention. Shown is the present invention having a unit for powering the raising and lowering of a flag 24 comprising a motor 22, gear box 44, drive wheel 48 and with a respective housing 34 and cover 36 for the components removed to show detail. A drive wheel housing cover 50 serves as a maintenance panel for servicing the electrical components and the drive wheel 48 when needed.

Figure 6:
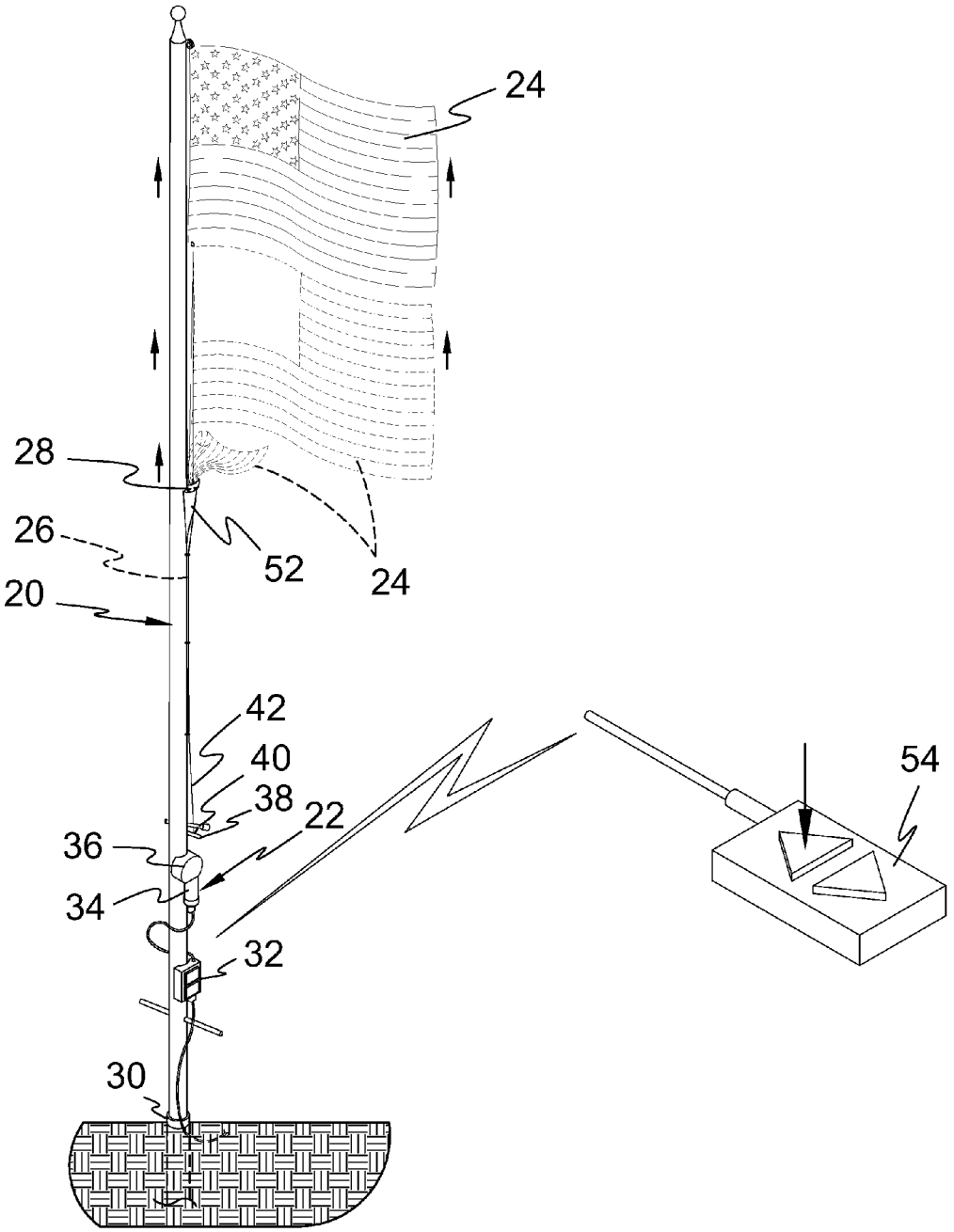
FIG. 6 is an illustrative view of the motorized flag pole of the present invention.

Referring to FIG. 6, shown is an illustrative view of the motorized flag pole of the present invention. Shown is the present invention comprising a flag pole 20 positioned within an inground receptacle 30 with the pole 20 incorporating a motor 22 having a motor housing 34 and drive wheel 48 therein tethered to a flag 24. Also provided is a flag storage compartment 26 having a flag guideway housing 52 guiding the flag 24 into and out of the flag compartment 26. The present invention provides a flag pole mounted switch 32 to move the flag 24 from a stored position to a displayed position and back to a stored position. Optionally provided is a remote control switch 54 that will actuate flag movement to a displayed position or a stored position.

Figure 7:
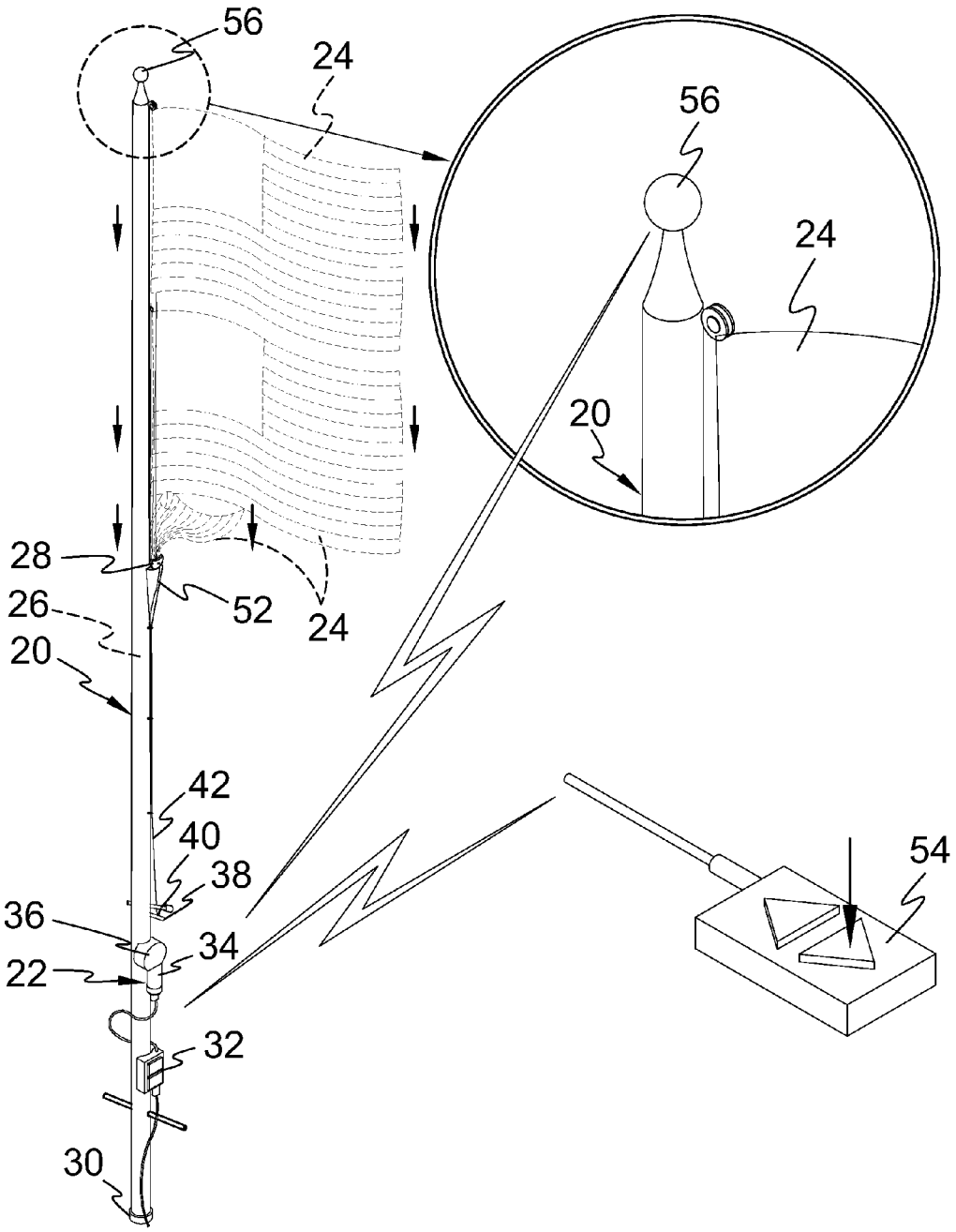
FIG. 7 is an illustrative view of the motorized flag pole of the present invention.

Referring to FIG. 7, shown is an illustrative view of the motorized flag pole of the present invention. Depicted are two components for raising and lowering a flag 24 mounted to the flag pole 20. A remote control switch 54 can be incorporated to raise and lower the flag 24. Also envisioned is mounting an anemometer 56 atop the flag pole 20 in electrical communication with the flag motor 22, whereby excessive wind speed will allow the lowering of the flag 24 into the storage compartment 26. Both of these additional components of the present invention can be used in conjunction with the switch 32 mounted to the pole 20 or remotely mounted that will actuate the raising and displaying of the flag 24 from the storage compartment 26 and lower the flag 24 from its displayed position to its stored position within the flag storage compartment 26.

Figure 8:
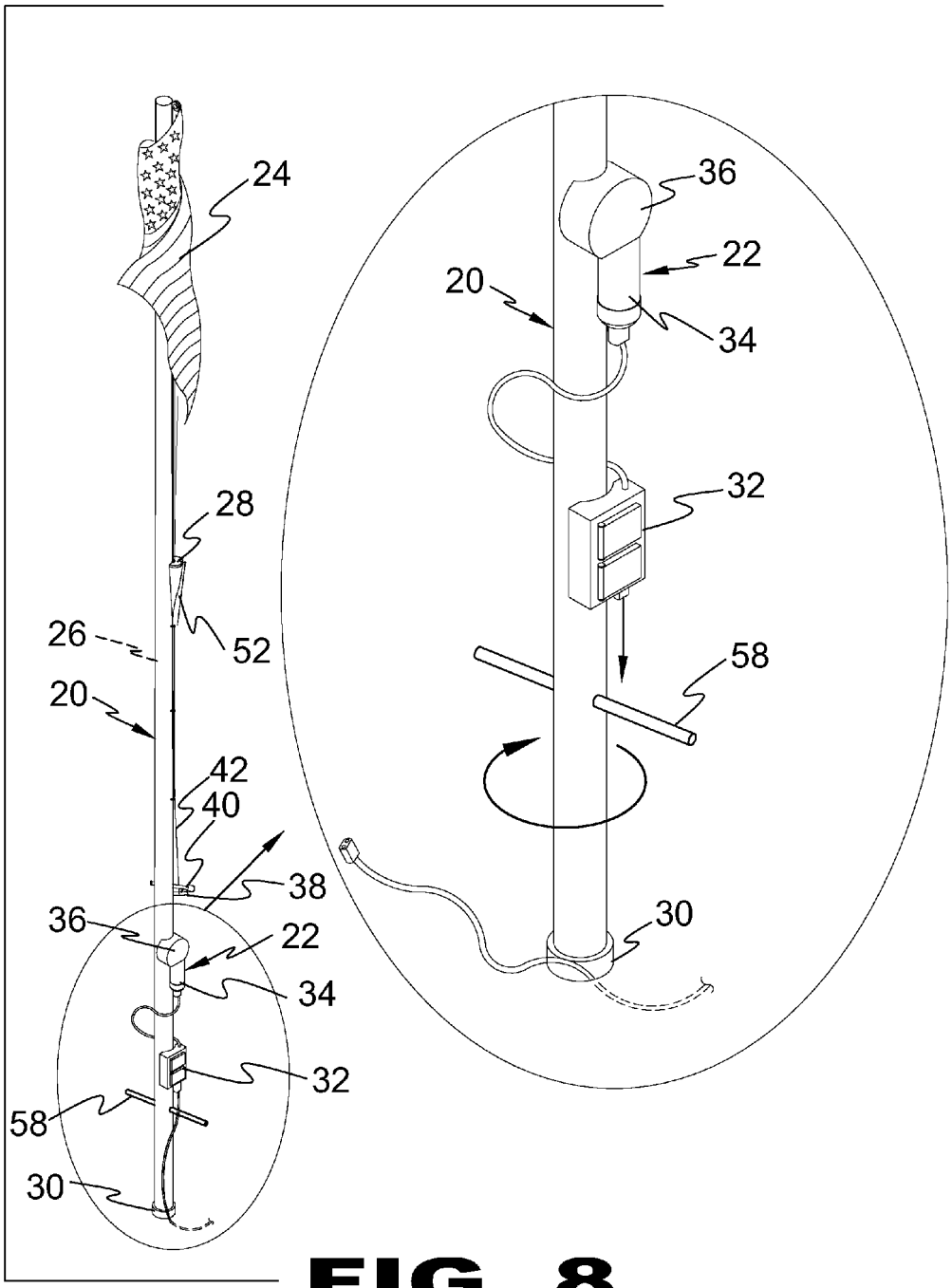
FIG. 8 is an illustrative view of the motorized flag pole of the present invention.

Referring to FIG. 8, shown is an illustrative view of the motorized flag pole of the present invention. The present invention provides an inground receptacle 30 that serves as anchor for the flag pole 20 enabling the flag pole 20 to rotate within the receptacle 30 to overcome the problem of a flag 24 wrapping around the pole 20 that cannot be unwound especially when wet. Therefore the present invention provides for disconnecting the electricity then grasping a provided twist handle 58 and rotating the flag pole 20 until the flag 24 is unwound, wherein it can be left in its display state or lowered into the flag storage compartment 26.

Figure 9:
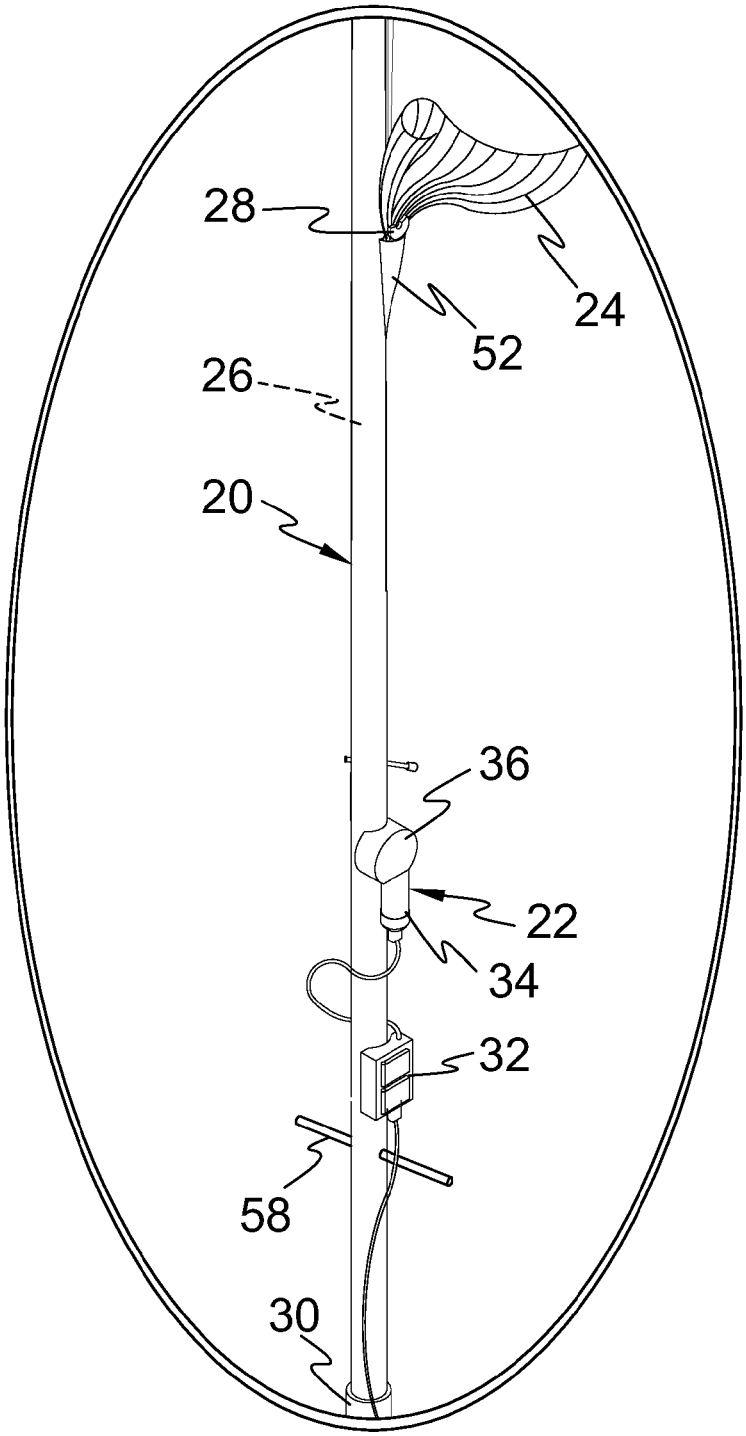
FIG. 9 is an illustrative view of the motorized flag pole of the present invention while retracting a flag.

Referring to FIG. 9, shown is an illustrative view of the motorized flag pole of the present invention while retracting a flag. Shown is the present invention retracting a flag 24 into the storage compartment 26 that is provided with a sensor actuated lid 28 for closing the storage compartment 26 when the flag 24 is stored.

Figure 10:
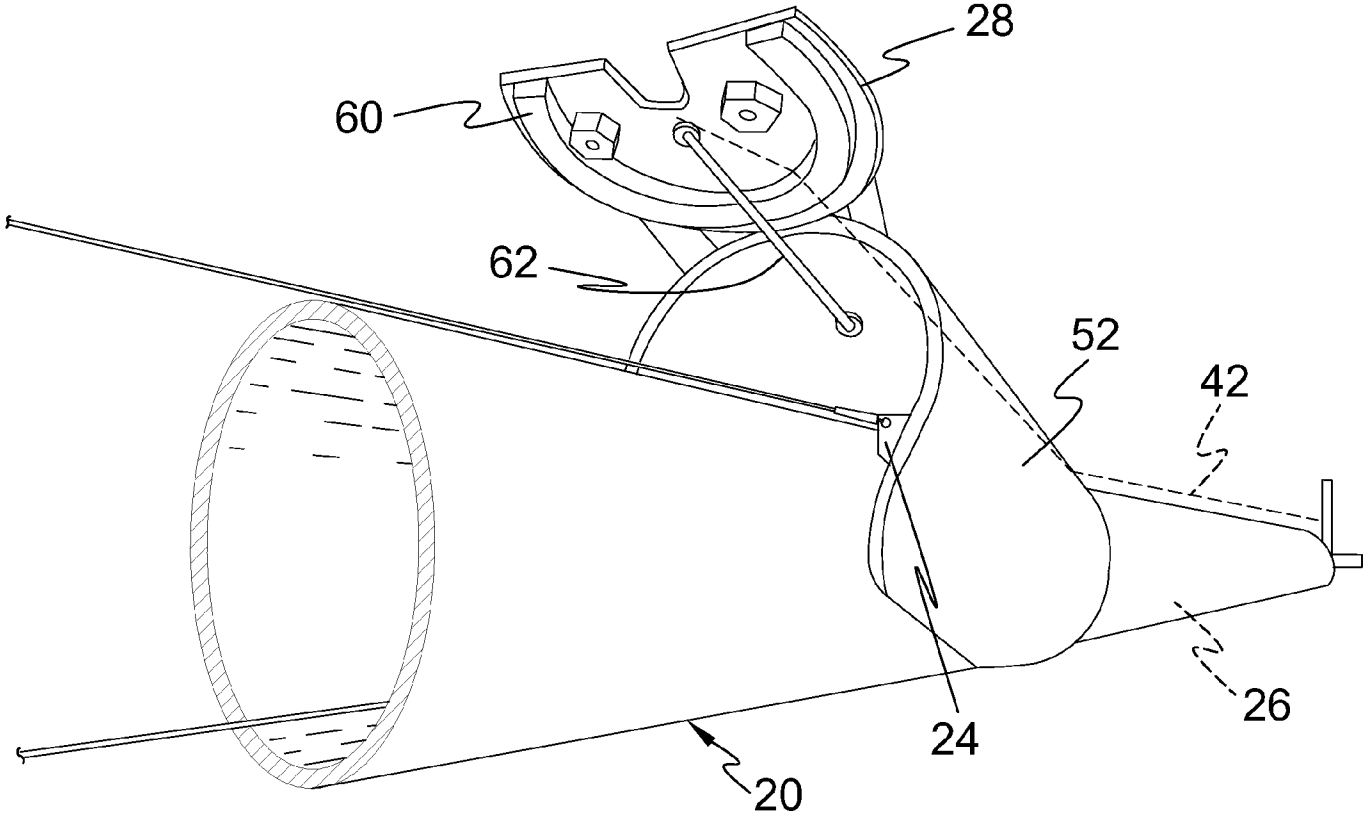
FIG. 10 is an illustrative view of the lid closure spring of the flag guideway housing.

Referring to FIG. 10, shown is an illustrative view of the lid closure spring of the flag guideway housing. The present invention provides a flag guideway housing 52 with the lid 28 having a weather seal gasket 60 to prevent water and debris from entering the guideway housing 52. Also shown is a lid closure spring 62, so that when the tension on the trigger 38 is released the closure spring 62 will keep the lid 28 in a closed tensioned state.

What is claimed is:

1. A motorized flag raising and lowering device which comprises:

a) a flag pole being hollow and having a storage compartment therein with a side exit port;
b) a pulley on an upper end of the flag pole;
c) a drive wheel in a lower end of the flag pole;
d) a continuous halyard extending about the pulley and the drive wheel through the flag pole and out of the side exit port;
e) a flag connected to the halyard;
f) a reversible motor assembly mounted to the flag pole and connected to the drive wheel;

g) means for operating the reversible motor assembly, whereby when the reversible motor assembly is activated by the operating means the flag can be lowered into the storage compartment within the flag pole, while the flag can also be raised from the storage compartment and out of the exit port for display;

h) a flag guideway housing affixed to the flag pole at the side exit port, a lid hinged to the flag guideway housing, and a weather seal gasket mounted to underside of the lid to prevent water and debris from entering the flag guideway housing; and i) a trigger on side of the flag pole; a trigger spring in the trigger, a line extending between the trigger and top side of the lid, and a lid closure spring between underside of the lid and the flag guideway housing, whereby when the trigger is squeezed compressing the trigger spring tensioning of the line will raise the lid and when releasing the trigger the trigger spring will extend releasing tension on the line, whereupon the lid closure spring will keep the lid in a closed position.

2. The device as recited in claim 1, wherein the reversible motor assembly comprises:

a) an electric motor having a motor shaft;

b) a motor housing;

c) a gear box coupled to the motor shaft and the drive wheel; and d) a gear box cover.

3. The device as recited in claim 2, further comprising:

a) the flag pole having a lower elongated aperture adjacent the drive wheel; and b) a drive wheel housing cover removably connected about the flag pole at the lower elongated aperture to serve as a maintenance panel for the drive wheel when needed.

4. The device as recited in claim 1, further comprising:

a) an inground receptacle to enable rotation of the flag pole; and b) a twist handle transversely mounted through the flag pole to help unwind the flag wrapped around the flag pole.

5. The device as recited in claim 1, wherein the operating means comprises a manual reversing switch mounted to the flag pole and electrically connected directly to the reversible motor assembly.

6. The device as recited in claim 1, wherein the operating means comprises a remote control reversing switch which sends a transmitted signal to the reversible motor assembly.

7. The device as recited in claim 1, wherein the operating means comprises an anemometer mounted atop the flag pole in electrical communication with the reversible motor assembly to lower the flag into the storage compartment within the flag pole.

* * * * *